US007473343B2

(12) United States Patent
Sakamoto et al.

(10) Patent No.: US 7,473,343 B2
(45) Date of Patent: Jan. 6, 2009

(54) METHOD OF MANUFACTURING RARE-EARTH MAGNET, AND PLATING BATH

(75) Inventors: Takeshi Sakamoto, Tokyo (JP); Yasuyuki Nakayama, Tokyo (JP); Tatsuhiro Iwai, Tokyo (JP); Tomomi Yamamoto, Tokyo (JP)

(73) Assignee: TDK Corporation, Tokyo (JP)

( * ) Notice: Subject to any disclaimer, the term of this patent is extended or adjusted under 35 U.S.C. 154(b) by 81 days.

(21) Appl. No.: 10/788,464

(22) Filed: Mar. 1, 2004

(65) Prior Publication Data

US 2004/0188267 A1 Sep. 30, 2004

(30) Foreign Application Priority Data

Mar. 5, 2003 (JP) ..... 2003-058738

(51) Int. Cl.
*C25D 5/12* (2006.01)
*C25D 3/16* (2006.01)
*C23C 28/00* (2006.01)

(52) U.S. Cl. ..... 205/181; 205/191; 205/271

(58) Field of Classification Search ..... 205/181, 205/191, 271; 106/1.25
See application file for complete search history.

(56) References Cited

U.S. PATENT DOCUMENTS 2,986,501 A * 5/1961 Martin ..... 205/277
3,183,067 A * 5/1965 Du Rose et al. ..... 428/639
4,959,273 A * 9/1990 Hamamura et al. ..... 428/548
5,167,793 A * 12/1992 Jozefowicz ..... 205/121
5,290,425 A 3/1994 Momotani et al.

FOREIGN PATENT DOCUMENTS

| | | | |
|---|---|---|---|
| JP | 50118930 A | * | 9/1975 |
| JP | A 60-54406 | | 3/1985 |
| JP | A-62-278293 | | 12/1987 |
| JP | A 63-198305 | | 8/1988 |
| JP | A 63-211703 | | 9/1988 |
| JP | A 1-286407 | | 11/1989 |
| JP | A 2-26003 | | 1/1990 |

(Continued)

OTHER PUBLICATIONS

Lowenheim, "Electroplating", c. no month, 1978, pp. 212-213.*

(Continued)

*Primary Examiner*—Edna Wong
(74) *Attorney, Agent, or Firm*—Oliff & Berridge, PLC

(57) ABSTRACT

Provided are a method of manufacturing a rare-earth magnet with superior corrosion resistance, and a plating bath used for the method. A first protective film including nickel and a second protective film including nickel and sulfur are laminated in order on a magnet body including a rare-earth element. The first protective film is formed through electroplating with a first plating bath including a nickel source, a conductive salt and a pH stabilizer, and having a concentration of the nickel source of 0.3 mol/l to 0.7 mol/l on a nickel atom basis and a conductivity of 80 mS/cm or over. Thereby, a rare-earth-rich phase can be prevented from being leached out, and the production of pinholes can be reduced. Therefore, the corrosion resistance of the rare-earth magnet can be improved.

9 Claims, 1 Drawing Sheet

FOREIGN PATENT DOCUMENTS

| | | | |
|---|---|---|---|
| JP | A-02-277794 | | 11/1990 |
| JP | A-04-091406 | | 3/1992 |
| JP | A-07-283018 | | 10/1995 |
| JP | A-09-007810 | | 1/1997 |
| JP | A 9-7810 | | 1/1997 |
| JP | 2002212775 A | * | 7/2002 |
| JP | A-2002-285377 | | 10/2002 |

OTHER PUBLICATIONS

Lowenheim, "Electroplating", c. (no month) 1978, pp. 212-213.*

Di Bari, "Nickel Electroplating", Based on the Article Nickel Plating by George Di Bari in the ASM Handbook, vol. 5, Surface Engineering, published by ASM International, Materials Park, Ohio 44073, 1994, p. 201, and reproduced with permission of the publisher, pp. 1-26.*

* cited by examiner

METHOD OF MANUFACTURING RARE-EARTH MAGNET, AND PLATING BATH

BACKGROUND OF THE INVENTION

1. Field of the Invention

The present invention relates to a method of manufacturing a rare-earth magnet comprising a magnet body including a rare-earth element, and a first protective film including nickel and a second protective film including nickel and sulfur, which are laminated in this order on the magnet body, and a plating bath used for the method.

2. Description of the Related Art

As a rare-earth magnet, for example, a Sm—$Co_5$ system, a $Sm_2$—$Co_{17}$ system, a Sm—Fe—N system, or a R—Fe—B system (R represents a rare-earth element) is known, and is used as a high-performance permanent magnet. Among them, attention is specifically given to the R—Fe—B system, because the R—Fe—B system uses neodymium (Nd) which is more abundant and relatively less expensive than samarium (Sm) as a main rare-earth element, and iron (Fe) which is also less expensive, and the R—Fe—B system has magnetic performance equal to or higher than the Sm—Co systems and the like.

However, the R—Fe—B system rare-earth magnet includes an easily oxidized rare-earth element as a main component and iron, so the corrosion resistance thereof is relatively low, thereby problems such as degradation and variations in performance arise.

In order to improve the corrosion resistance of the rare-earth magnet, a magnet on which various corrosion-resistant protective films are formed has been proposed (refer to Japanese Unexamined Patent Application Publication No. Sho 60-54406 or Hei 9-7810).

Although the corrosion resistance of the rare-earth magnet can be surely improved by the protective films, further improvement has been required. For example, there is a problem that the result of a salt spray test on a protective film made of metal or an alloy disclosed in Japanese Unexamined Patent Application Publication No. Sho 60-54406 is not satisfactory, so it is difficult for the rare-earth magnet to obtain sufficient corrosion resistance.

Moreover, the R—Fe—B system rare-earth magnet mainly includes a main phase, a rare-earth-rich phase and a boron-rich phase, so in the case where a protective film is formed through plating, when the R—Fe—B system rare-earth magnet comes into contact with a plating bath, the rare-earth-rich phase with an extremely low oxidation-reduction potential forms a local cell with the main phase or the boron-rich phase. Further, in the case of a nickel-plating bath, immersion plating in which the rare-earth-rich phase with a low oxidation-reduction potential is leached out, and nickel with a high oxidation-reduction potential is electrodeposited occurs. The rare-earth-rich phase is present in a grain boundary of the main phase, so when the rare-earth-rich phase is leached out, grain boundary corrosion will occur in the R—Fe—B system rare-earth magnet. It is difficult to plate a corroded portion, and even if a nickel-plating layer is formed through electroplating, it is difficult to completely cover the corroded portion, because leaching of the rare-earth-rich phase is local corrosion. Industrially, the locally corroded portion is forcefully covered with a plating film with a thickness of 10 μm or over; however, when the portion is not sufficiently covered, pinholes are produced in a protective film, so a problem that sufficient corrosion resistance cannot be obtained arises.

SUMMARY OF THE INVENTION

In view of the foregoing, it is an object of the invention to provide a method of manufacturing a rare-earth magnet capable of improving its corrosion resistance, and a plating bath used for the method.

A first method of manufacturing a rare-earth magnet according to the invention comprises the steps of: forming a first protective film including nickel on a magnet body including a rare-earth element through electroplating with a first plating bath including a nickel source, a conductive salt and a pH stabilizer, and having a concentration of the nickel source of 0.3 mol/l to 0.7 mol/l on a nickel atom basis and a conductivity of 80 mS/cm or over; and forming a second protective film including nickel and sulfur on the first protective film.

At this time, the second protective film is preferably formed through electroplating with a second plating bath including a nickel source, a conductive salt, a pH stabilizer and an organic sulfur compound, and having a conductivity of 80 mS/cm or over.

A second method of manufacturing a rare-earth magnet according to the invention comprises the steps of: forming a first protective film including nickel on a magnet body including a rare-earth element through electroplating with a first plating bath including 0.3 mol/l to 0.7 mol/l of nickel ions, at least one kind selected from the group consisting of sulfate ions, chlorine ions, bromine ions, acetate ions and pyrophosphate ions, at least one kind selected from the group consisting of sodium ions, potassium ions, lithium ions, magnesium ions and ammonium ions, and at least one kind selected from the group consisting of borate ions and ammonium ions, and having a conductivity of 80 mS/cm or over; and forming a second protective film including nickel and sulfur on the first protective film.

At this time, the second protective film is preferably formed through electroplating with a second plating bath including nickel ions, at least one kind selected from the group consisting of sulfate ions, chlorine ions, bromine ions, acetate ions and pyrophosphate ions, at least one kind selected from the group consisting of sodium ions, potassium ions, lithium ions, magnesium ions and ammonium ions, at least one kind selected from the group consisting of borate ions and ammonium ions, and an organic sulfur compound, and having a conductivity of 80 mS/cm or over.

A first plating bath according to the invention comprises: a nickel source, a conductive salt and a pH stabilizer, wherein the concentration of the nickel source is 0.3 mol/l to 0.7 mol/l on a nickel atom basis, and the conductivity of the plating bath is 80 mS/cm or over.

A second plating bath according to the invention comprises: 0.3 mol/l to 0.7 mol/l of nickel ions; at least one kind selected from the group consisting of sulfate ions, chlorine ions, bromine ions, acetate ions and pyrophosphate ions; at least one kind selected from the group consisting of sodium ions, potassium ions, lithium ions, magnesium ions and ammonium ions; and at least one kind selected from the group consisting of borate ions and ammonium ions, wherein the conductivity of the plating bath is 80 mS/cm or over.

A third plating bath according to the invention comprises: a nickel source; a conductive salt; a pH stabilizer; and an organic sulfur compound, wherein the conductivity of the plating bath is 80 mS/cm or over.

A fourth plating bath according to the invention comprises: nickel ions; at least one kind selected from the group consisting of sulfate ions, chlorine ions, bromine ions, acetate ions and pyrophosphate ions; at least one kind selected from the group consisting of sodium ions, potassium ions, lithium ions, magnesium ions and ammonium ions; at least one kind selected from the group consisting of borate ions and ammonium ions; and an organic sulfur compound, wherein the conductivity of the plating bath is 80 mS/cm or over.

In the method of manufacturing a rare-earth magnet according to the invention, the first protective film is formed through electroplating with the first plating bath, so a rare-earth-rich phase can be prevented from being leached out, and the production of pinholes can be reduced. Thereby, the corrosion resistance of the rare-earth magnet can be improved.

Moreover, when the second protective film is formed through electroplating with the second plating bath, pinholes can be further reduced, and the corrosion resistance of the rare-earth magnet can be further improved.

DETAILED DESCRIPTION OF THE PREFERRED EMBODIMENTS

Figure 1:
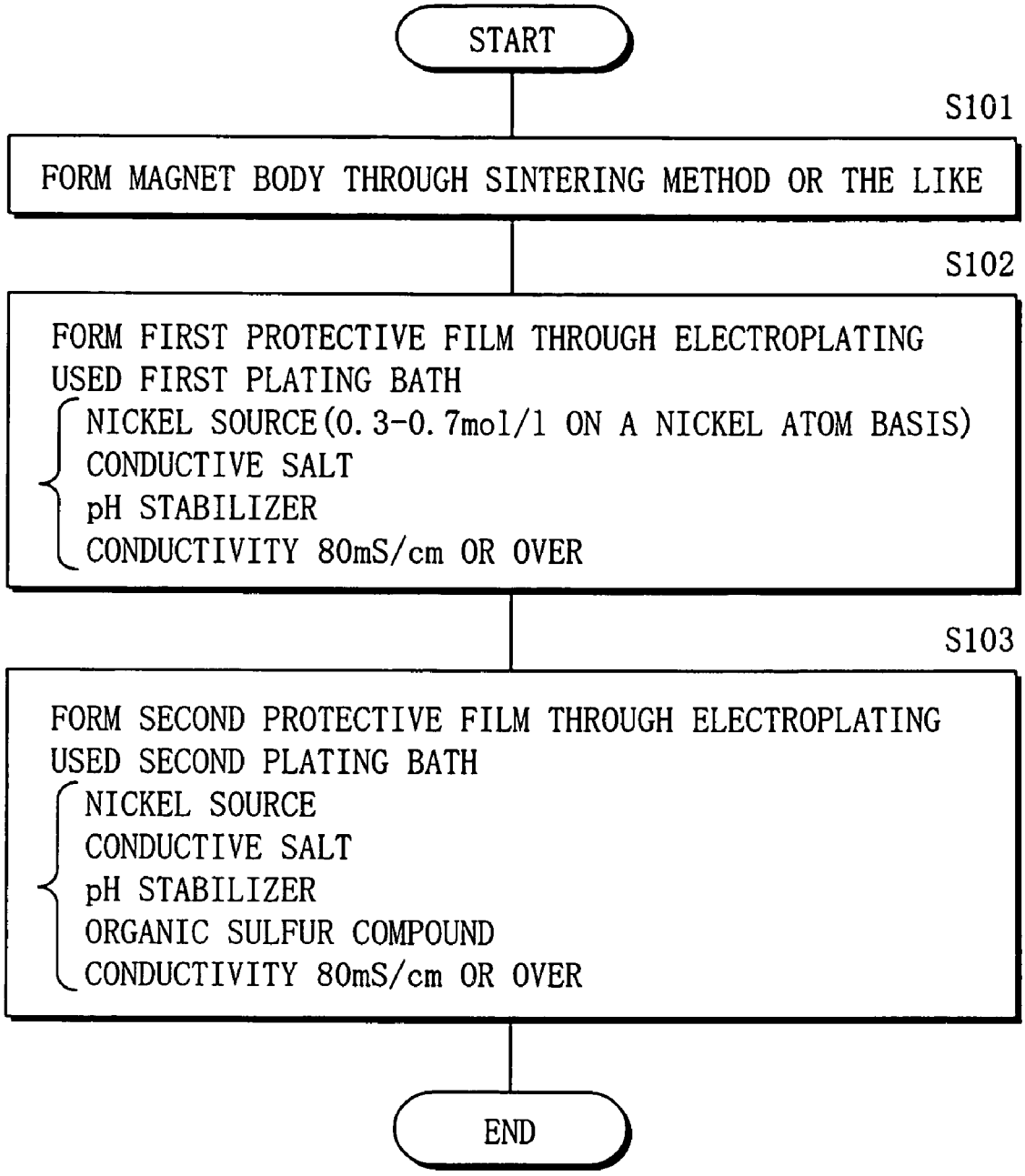
FIG. 1 is a flow chart showing a method of manufacturing a rare-earth magnet according to an embodiment of the invention.

A preferred embodiment of the present invention will be described in more detail below referring to the accompanying drawing.

In a method of manufacturing a rare-earth magnet according to an embodiment of the invention, a rare-earth magnet comprising a magnet body including a rare-earth element, and a first protective film and a second protective film which are laminated in this order on the magnet body.

The magnet body includes a permanent magnet including a transition metal element and a rare-earth element. The rare-earth element is a generic term for 16 elements in Group 3 of the long form of the periodic table of the elements which are yttrium (Y), and lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb) and lutetium (Lu) of the lanthanoid series.

An example of the permanent magnet of the magnet body is a permanent magnet comprising one or more kinds of rare-earth elements, iron (Fe) and boron (B). The magnet body includes a main phase with a substantially tetragonal crystal structure, a rare-earth-rich phase and a boron-rich phase. The grain diameter of the main phase is preferably 100 μm or less. The rare-earth-rich phase and the boron-rich phase are non-magnetic phases, and they are mainly present in a grain boundary of the main phase. In general, 0.5 vol % to 50 vol % of the non-magnetic phases are included.

As the rare-earth element, for example, at least one kind selected from the group consisting of neodymium, dysprosium, praseodymium and terbium is preferably included.

The rare-earth element content is preferably 8 at % to 40 at %. When the rare-earth element content is less than 8 at %, the crystal structure becomes the same cubic crystal structure as that of α-iron, so high coercivity (iHc) cannot be obtained, and on the other hand, when the rare-earth element content is larger than 40 at %, the non-magnetic rare-earth-rich phase is increased, thereby a residual magnetic flux density (Br) declines.

The iron content is preferably 42 at % to 90 at %. When the iron content is less than 42 at %, the residual magnetic flux density declines, and when the iron content is larger than 90 at %, the coercivity declines.

The boron content is preferably 2 at % to 28 at %. When the boron content is less than 2 at %, boron has a rhombohedral structure, thereby the coercivity is insufficient, and when the boron content is larger than 28 at %, the non-magnetic boron-rich phase is increased, thereby the residual magnetic flux density declines.

In addition, a part of iron may be replaced with cobalt (Co), which is represented by $Fe_{1-x}Co_x$. It is because temperature properties can be improved without loss of magnetic properties. In this case, the amount of cobalt, that is, x is preferably within a range of 0.5 or less in an atomic ratio. When the amount of cobalt is larger than the range, magnetic properties are degraded.

Moreover, a part of boron may be replaced with at least one kind selected from the group consisting of carbon (C), phosphorus (P), sulfur (S) and copper (Cu), because improvements in productivity and cost reduction can be achieved. In this case, the total content of carbon, phosphorus, sulfur and copper is preferably 4 at % or less of the total. When the content is larger than 4 at %, magnetic properties are degraded.

Further, in order to achieve improvements in coercivity and productivity and cost reduction, one or more kinds selected from the group consisting of aluminum (Al), titanium (Ti), vanadium (V), chromium (Cr), manganese (Mn), bismuth (Bi), niobium (Nb), tantalum (Ta), molybdenum (Mo), tungsten (W), antimony (Sb), germanium (Ge), tin (Sn), zirconium (Zr), nickel (Ni), silicon (Si), gallium (Ga), copper (Cu), hafnium (Hf) and the like may be added. In this case, it is preferable that the total added amount is 10 at % or less of the total. When the amount is larger than 10 at %, magnetic properties are degraded.

In addition, as an inevitable impurity, oxygen (O), nitrogen (N), carbon (C), calcium (Ca) or the like may be included within a range of 3 at % or less of the total.

Examples of the permanent magnet of the magnet body include a permanent magnet including one or more kinds of rare-earth elements and cobalt, and a permanent magnet including one or more kinds of rare-earth elements, iron and nitrogen (N). More specifically, for example, a permanent magnet including samarium and cobalt such as a $Sm—Co_5$ system or a $Sm_2—Co_{17}$ system (numbers indicate atomic ratios), and a permanent magnet including neodymium, iron and boron such as a Nd—Fe—B system are cited.

The first protective film is made of nickel or an alloy including nickel. Although nickel is preferable because of its high productivity, in terms of hardness, durability, corrosion resistance and so on, a nickel alloy including at least one kind selected from the group consisting of iron, cobalt, copper, zinc (Zn), phosphorus (P), boron, manganese (Mn), tin (Sn) and tungsten (W) if necessary is preferable.

Moreover, as will be described later, the first protective film is formed through electroplating with a first plating bath including a nickel source, a conductive salt and a pH stabilizer and having a conductivity of 80 mS/cm or over. Thereby, in the embodiment, pinholes in the first protective film can be reduced, and corrosion resistance can be improved.

For example, the first protective film preferably has a thickness of 3 μm to 50 μm inclusive, and more preferably 5 μm to 40 μm inclusive. In the embodiment, pinholes in the first protective film are reduced, so even if the thickness of the first protective film is thin, sufficient corrosion resistance can be obtained. The average crystal grain diameter of the first protective film is preferably 1 μm or less, because pinholes can be reduced.

The second protective film is provided to further improve the corrosion resistance and reduce the thickness of the first protective film, and is made of an alloy including nickel and sulfur. Although the second protective film is preferably made of an alloy including nickel and sulfur in terms of productivity, the second protective film is preferably made of an alloy including at least one kind selected from the group consisting of iron, cobalt, copper, zinc, phosphorus, boron, manganese, tin and tungsten if necessary, nickel and sulfur in terms of hardness, durability, corrosion resistance and so on. The sulfur content in the second protective film is preferably within a range of 0.01 wt % to 0.8 wt % inclusive. It is because when sulfur is included, an oxidation-reduction potential is reduced, and even if pinholes are produced in the second protective film, the second protective film acts as a sacrificial anode for the first protective film, thereby the corrosion resistance can be improved as a whole.

Moreover, as will be described later, the second protective film is preferably formed through electroplating with a second plating bath including a nickel source, a conductive salt, a pH stabilizer and an organic sulfur compound, and having a conductivity of 80 mS/cm or over, because pinholes in the second protective film can be further reduced.

For example, the second protective film preferably has a thickness of 1 μm to 20 μm inclusive, and more preferably 5 μm to 15 μm inclusive. It is because as pinholes are reduced, even if the thickness of the second protective film is thin, sufficient corrosion resistance can be obtained. The average crystal grain diameter of the second protective film is preferably 1 μm or less, because a favorable film with a small number of pinholes can be formed.

For example, as shown in FIG. 1, the rare-earth magnet can be manufactured through forming the magnet body (step S101), forming the first protective film through electroplating (step S102), and forming the second protective film on the first protective film through electroplating (step S103).

For example, the magnet body is preferably formed through a sintering method as follows (refer to step S101). At first, an alloy with a desired composition is cast to form an ingot. Next, the obtained ingot is coarsely pulverized with a stamp mill or the like to form particles with a diameter of 10 μm to 800 μm, and the particles are finely pulverized with a ball mill or the like to form powder with a diameter of 0.5 μm to 5 μm. Next, the obtained powder is preferably molded in a magnetic field. In this case, it is preferable that the magnetic field strength is set to 10 kOe or over, and the molding pressure is set to approximately 1 $Mg/cm^2$ to 5 $Mg/cm^2$.

After that, the obtained molded body is sintered for 0.5 to 24 hours at 1000° C. to 1200° C., and then is cooled. The sintering atmosphere is preferably an atmosphere of inert gas such as argon (Ar) gas, or a vacuum atmosphere. Further, after that, an aging treatment is preferably performed for 1 to 5 hours at 500° C. to 900° C. in an atmosphere of inert gas. The aging treatment may be performed a plurality of times.

In the case where two or more kinds of rare-earth elements are used, a mixture such as misch metal may be used as a material. Further, the magnet body may be manufactured through a method other than the sintering method. For example, the magnet body may be manufactured through a so-called quenching method which is used when a bulk magnet is manufactured.

Moreover, the first protective film is preferably formed through electroplating with the first plating bath including the nickel source, the conductive salt and the pH stabilizer and having a conductivity of 80 mS/cm or over (refer to step S102).

The concentration of the nickel source in the first plating bath is preferably within a range of 0.3 mol/l to 0.7 mol/l on a nickel atom basis. When the concentration of nickel atoms is as low as 0.7 mol/l or less, immersion plating of nickel onto the rare-earth-rich phase can be prevented, thereby corrosion of the rare-earth-rich phase can be prevented. Further, the concentration of nickel atoms in the first plating bath is 0.3 mol/l or over, because when the concentration is too low, the electrolysis of water occurs to produce hydrogen, thereby it is difficult to carry out industrially appropriate production.

For example, the nickel source of the first plating bath preferably includes at least one kind selected from the group consisting of nickel sulfate ($NiSO_4$), nickel chlorides ($NiCl_2$, $NiCl_3$), nickel bromides ($NiBr_2$, $NiBr_3$), nickel acetate ($Ni(CH_3COO)_2$), nickel pyrophosphate ($Ni_2P_2O_7$). Further, a salt hydrate thereof, for example, nickel sulfate hexahydrate ($NiSO_4.6H_2O$) or nickel chloride hexahydrate ($NiCl_2.6H_2O$) may be used.

The conductive salt is provided to reduce the probability that nickel ions will come into contact with a surface of the magnet body and to slow the immersion plating of nickel onto the rare-earth-rich phase. As the conductive salt of the first plating bath, for example, it is preferable that at least one kind selected from the group consisting of ammonium sulfate, sodium sulfate, potassium sulfate, lithium sulfate, magnesium sulfate, ammonium chloride, sodium chloride, potassium chloride, lithium chloride, magnesium chloride, ammonium bromide, sodium bromide, potassium bromide, lithium bromide and magnesium bromide is included. They may be included as salt hydrates. The concentration of the conductive salt in the first plating bath is preferably set so that the conductivity of the first plating bath can be 80 mS/cm or over. It is because when the conductivity is lower than 80 mS/cm, an effect of slowing immersion plating by the conductive salt cannot be obtained.

The pH stabilizer is provided to stabilize the pH of the surface of the magnet body so as to further prevent immersion plating of nickel onto the rare-earth-rich phase. The concentration of the pH stabilizer in the first plating bath is preferably within a range of 0.5 mol/l to 1.5 mol/l inclusive, and more preferably 0.5 mol/l to 1.0 mol/l inclusive, because the immersion plating can be further prevented within the range. As the pH stabilizer of the first plating bath, for example, at least one kind selected from the group consisting of boric acid, ammonium borate, sodium borate, potassium borate, lithium borate, magnesium borate and ammonia is preferably included. They may be included as salt hydrates. Boric acid in the group includes a structure such as $BO_3^-$, $5(B_2O_3)O^{2-}$, $B_4O_7^{2-}$ or $BO_2^-$.

In other words, for example, it is preferable that the first plating bath includes 0.3 mol/l to 0.7 mol/l of nickel ions, at least one kind selected from the group consisting of sulfate ions, chlorine ions, bromine ions, acetate ions and pyrophosphate ions, at least one kind selected from the group consisting of sodium ions, potassium ions, lithium ions, magnesium ions, and ammonium ions, and at least one kind selected from the group consisting of borate ions and ammonium ions, and has a conductivity of 80 mS/cm or over.

When the first protective film is made of a nickel alloy, a material of an element which forms an alloy with nickel is added to the first plating bath. As the material, for example, at least one kind selected from the group consisting of sulfate, chloride, bromide, acetate and pyrophosphate of the element, and a salt hydrate thereof is preferable. Further, any other additives for improving properties such as a typical semi-bright nickel plating additive for improving corrosion resistance may be added to the first plating bath.

The second protective film is preferably formed through electroplating with the second plating bath including the nickel source, the conductive salt, the pH stabilizer and the organic sulfur compound, and having a conductivity of 80 mS/cm or over (refer to step S103).

As the nickel source of the second plating bath, for example, at least one kind selected from the group consisting of nickel sulfate, nickel chlorides, nickel bromides, nickel acetate and nickel pyrophosphate is preferably included, and a salt hydrate thereof may be used. The concentration of the nickel source is not specifically limited, because the nickel source does not make direct contact with the magnet body, so immersion plating of the nickel onto the rare-earth-rich phase will not occur.

The conductive salt is provided to reduce the possibility that nickel ions will come into contact with pinholes of the first protective film so as to easily cover the pinholes. As the conductive salt of the second plating bath, for example, at least one kind selected from the group consisting of ammonium sulfate, sodium sulfate, potassium sulfate, lithium sulfate, magnesium sulfate, ammonium chloride, sodium chloride, potassium chloride, lithium chloride, magnesium chloride, ammonium bromide, sodium bromide, potassium bromide, lithium bromide and magnesium bromide is preferably included, and a salt hydrate thereof may be used. The concentration of the conductive salt in the second plating bath is preferably set so that the conductivity of the second plating bath can be 80 mS/cm or over. It is because when the conductivity is lower than 80 mS/cm, an effect by the conductive salt declines.

The pH stabilizer is provided to stabilize pH so as to prevent the immersion plating of nickel ions onto the rare-earth-rich phase. The concentration of the pH stabilizer in the second plating bath is preferably within a range of 0.5 mol/l to 1.5 mol/l inclusive, and more preferably 0.5 mol/l to 1.0 mol/l inclusive, because a higher effect can be obtained within the range. As the pH stabilizer of the second plating bath, for example, at least one kind selected from the group consisting of boric acid, ammonium borate, sodium borate, potassium borate, lithium borate, magnesium borate and ammonia is preferably included, and a salt hydrate thereof may be used. Further, boric acid in the group includes a structure such as $BO_3^-$, $5(B_2O_3)O^{2-}$, $B_4O_7^{2-}$ or $BO_2^-$ as in the case of the first plating bath.

As the organic sulfur compound, for example, a sulfur compound including N—C═S such as thiourea or a derivative thereof is cited. As the organic sulfur compound, only one kind or a mixture of two or more kinds may be used.

In other words, for example, it is preferable that the second plating bath includes nickel ions, at least one kind selected from the group consisting of sulfate ions, chlorine ions, bromine ions, acetate ions and pyrophosphate ions, at least one kind selected from the group consisting of sodium ions, potassium ions, lithium ions, magnesium ions and ammonium ions, at least one kind selected from the group consisting of borate ions and ammonium ions, and the organic sulfur compound, and has a conductivity of 80 mS/cm or over.

When the second protective film is made of an alloy including nickel, sulfur and any other element, a material of the element is added to the second plating bath. As the material, for example, at least one kind selected from the group consisting of sulfate, chloride, bromide, acetate and pyrophosphate of the element, and a salt hydrate thereof is preferable. Further, any other various additives for improving properties may be added to the second protective film.

Moreover, before forming the first protective film, pretreatment may be performed. Examples of the pretreatment include degreasing by an organic solvent and activation by acid treatment after degreasing.

Thus, according to the embodiment, the first protective film is formed through electroplating with the first plating bath including the nickel source, the conductive salt and the pH stabilizer and having a concentration of the nickel source of 0.3 mol/l to 0.7 mol/l on a nickel atom basis and a conductivity of 80 mS/cm or over, or with the first plating bath including 0.3 mol/l to 0.7 mol/l of nickel ions, at least one kind selected from the group consisting of sulfate ions, chlorine ions, bromine ions, acetate ions and pyrophosphate ions, at least one kind selected from the group consisting of sodium ions, potassium ions, lithium ions, magnesium ions and ammonium ions, and at least one kind selected from the group consisting of borate ions and ammonium ions, and having a conductivity of 80 mS/cm or over, so the rare-earth-rich phase can be prevented from being leached out, and pinholes can be reduced. Therefore, the corrosion resistance can be improved.

Specifically, when the second protective film is formed through electroplating with second plating bath including the nickel source, the conductive salt, the pH stabilizer and the organic sulfur compound, and having a conductivity of 80 mS/cm or over, or with the second plating bath including nickel ions, at least one kind selected from the group consisting of sulfate ions, chlorine ions, bromine ions, acetate ions and pyrophosphate ions, at least one kind selected from the group consisting of sodium ions, potassium ions, lithium ions, magnesium ions and ammonium ions, at least one kind selected from the group consisting of borate ions and ammonium ions, and the organic sulfur compound, and having a conductivity of 80 mS/cm or over, pinholes can be further reduced, thereby the corrosion resistance can be further improved.

Moreover, when the average crystal grain diameter of the first protective film is 1 μm or less, pinholes can be further reduced, thereby the corrosion resistance can be further improved.

Next, specific examples of the invention will be described below.

After a sintered body with a composition of 14Nd-1Dy-7B-78Fe (numbers indicate atomic ratios) produced by a powder metallurgy method was subjected to a heat treatment for two hours at 600° C. in an argon atmosphere, the sintered body was processed so as to have a size of 56×40×8 (mm), and then the sintered body was chamfered through barrel polishing so as to obtain a magnet body.

Next, after the magnet body was cleaned with an alkaline degreasing solution, the surface of the magnet body was activated by a nitric acid solution, and then the magnet body was thoroughly rinsed in water. Next, the first protective film with a thickness of 5 μm was formed on the surface of the magnet body through electroplating with the first plating bath having a composition and a conductivity shown in Table 1. The current density was 1 A/dm$^2$ or less on average.

In Example 1, the first plating bath including 0.5 mol/l of nickel sulfate as the nickel source, 1.5 mol/l of potassium bromide as the conductive salt and 1.0 mol/l of boric acid as the pH stabilizer and having a conductivity of 127 mS/cm was used. In other words, the concentration of the nickel source was 0.5 mol/l on a nickel atom basis, and the concentration of nickel ions was 0.5 mol/l.

The first plating bath in Example 2 was equivalent to that in Example 1, except that a semi-brightener was added to the first plating bath.

In Example 3, the first plating bath including 0.3 mol/l of nickel bromide as the nickel source, 1.0 mol/l of lithium sulfate as the conductive salt, and 0.1 mol/l of sodium borate and 1.4 mol/l of boric acid as the pH stabilizer, and having a conductivity of 108 mS/cm was used. In other words, the concentration of the nickel source was 0.3 mol/l on a nickel atom basis, and the concentration of nickel ions was 0.3 mol/l.

In Example 4, the first plating bath including 0.15 mol/l of nickel pyrophosphate as the nickel source, 1.0 mol/l of potassium pyrophosphate as a complexing agent and the conductive salt, 1.0 mol/l of ammonium sulfate as the conductive salt, and ammonia water with a pH of 8 and 1.0 mol/l of boric acid as the pH stabilizer and having a conductivity of 102 mS/cm was used. In other words, the concentration of the nickel source was 0.3 mol/l on a nickel atom basis, and the concentration of nickel ions was 0.3 mol/l.

In Example 5, the first plating bath including 0.7 mol/l of nickel chloride as the nickel source, 1.5 mol/l of sodium sulfate as the conductive salt, 1.2 mol/l of boric acid as the pH stabilizer and a semi-brightener, and having a conductivity of 113 mS/cm was used. In other words, the concentration of the nickel source was 0.7mol/l on a nickel atom basis, and the concentration of nickel ions was 0.7 mol/l.

In Example 6, the first plating bath including 0.5 mol/l of nickel sulfate as the nickel source, 1.0 mol/l of lithium chloride as the conductive salt, 0.7 mol/l of boric acid as the pH stabilizer and a semi-brightener and having a conductivity of 90 mS/cm was used. In other words, the concentration of the nickel source was 0.5 mol/l on a nickel atom basis, and the concentration of nickel ions was 0.5 mol/l.

In Example 7, the first plating bath including 0.4 mol/l of nickel chloride as the nickel source, 1.0 mol/l of lithium sulfate as the conductive salt, 1.0 mol/l of boric acid as the pH stabilizer and a semi-brightener and having a conductivity of 82 mS/cm was used. In other words, the concentration of the nickel source was 0.4 mol/l on a nickel atom basis, and the concentration of nickel ions was 0.4 mol/l.

After the first protective film was formed, the second protective film with a thickness of 5 μm was formed on a surface of the first protective film through electroplating with the second plating bath with a composition and a conductivity shown in Table 1. Thereby, rare-earth magnets of Examples 1 through 7 were obtained.

In Example 1, the second plating bath including 0.5 mol/l of nickel chloride as the nickel source, 1.5 mol/l of potassium chloride as the conductive salt, 1.0 mol/l of boric acid as the pH stabilizer and a brightener including the organic sulfur compound, and having a conductivity of 186 mS/cm was used.

In Example 2, the same second plating bath as that in Example 1 was used.

In Example 3, the second plating bath including 0.7 mol/l of nickel sulfate as the nickel source, 1.0 mol/l of ammonium chloride as the conductive salt, 0.7 mol/l of ammonium borate as the pH stabilizer and a brightener including the organic sulfur compound, and having a conductivity of 132 mS/cm was used.

In Example 4, the second plating bath including 0.5 mol/l of nickel bromide as the nickel source, 1.5 mol/l of ammonium sulfate as the conductive salt, 1.2 mol/l of boric acid as the pH stabilizer and a brightener including the organic sulfur compound, and having a conductivity of 118 mS/cm was used.

In Example 5, the second plating bath including 0.3 mol/l of nickel acetate as the nickel source, 2 mol/l of lithium chloride as the conductive salt, 0.7 mol/l of boric acid as the pH stabilizer and a brightener including the organic sulfur compound, and having a conductivity of 162 mS/cm was used.

In Example 6, the second plating bath including 0.5 mol/l of nickel chloride as the nickel source, 1.5 mol/l of potassium chloride as the conductive salt, 1.0 mol/l of boric acid as the pH stabilizer and a brightener including the organic sulfur compound, and having a conductivity of 186 mS/cm was used.

In Example 7, the second plating bath including 0.5 mol/l of nickel chloride as the nickel source, 1.0 mol/l of magnesium sulfate as the conductive salt, 0.5 mol/l of boric acid as the pH stabilizer and a brightener including the organic sulfur compound, and having a conductivity of 85 mS/cm was used.

As Comparative Example 1 relative to the examples, a rare-earth magnet was formed as in the case of the examples, except that the first plating bath with a composition and a conductivity shown in Table 1 and the second plating bath with a composition and a conductivity shown in Table 1 were used. In Comparative Example 1, the first plating bath including 1.0 mol/l of nickel sulfate and 0.25 mol/l of nickel chloride as the nickel source, 0.6 mol/l of boric acid as the pH stabilizer and a semi-brightener and having a conductivity of 58 mS/m was used, and the second plating bath including 1.0 mol/l of nickel sulfate and 0.25 mol/l of nickel chloride as the nickel source, 0.6 mol/l of boric acid as the pH stabilizer and a brightener including the organic sulfur compound, and having a conductivity of 59 mS/cm was used. In other words, in Comparative Example 1, the first plating bath and the second plating bath both including no conductive salt and having a lower conductivity were used.

Moreover, as Comparative Example 2 relative to the examples, a rare-earth magnet was formed as in the case of the examples, except that the first protective film with a thickness of 10 μm was formed by using the first plating bath having a composition and a conductivity shown in Table 1, and the second protective film was not formed. In Comparative Example 2, the first plating bath including 1.0 mol/l of nickel sulfamate and 0.1 mol/l of nickel bromide as the nickel source, and 0.5 mol/l of boric acid as the pH stabilizer, and having a conductivity of 72 mS/cm was used. In other words, in Comparative Example 2, the first plating bath including no conductive salt and having a lower conductivity was used, and the second protective film was not formed.

The obtained rare-earth magnets of Examples 1 through 7 and Comparative Example 1 and 2 were subjected to a high-temperature high-humidity test for 24 hours at $0.2\times10^6$ Pa and 120° C. in a vapor atmosphere and a salt spray test for 24 hours according to JIS-C-0023 to evaluate the corrosion resistance of the rare-earth magnets. The appearance thereof was checked with the unaided eye to determine the pass/fail status of the rare-earth magnets depending upon the presence or absence of rust. The results are shown in Table 1.

TABLE 1

| | FIRST PLATING BATH | | | SECOND PLATING BATH | | | HIGH- | |
|---|---|---|---|---|---|---|---|---|
| | COMPOSITION | | CONDUCTIVITY mS/cm | COMPOSITION | | CONDUCTIVITY mS/cm | TEMPERATURE HIGH-HUMIDITY TEST | SALT SPRAY TEST |
| EXAMPLE 1 | NICKEL SULFATE | 0.5 M | 127 | NICKEL CHLORIDE | 0.5 M | 186 | PASS | PASS |
| | POTASSIUM BROMIDE | 1.5 M | | POTASSIUM CHLORIDE | 1.5 M | | | |
| | BORIC ACID | 1.0 M | | BORIC ACID | 1.0 M | | | |
| | | | | BRIGHTENER | ADEQUATE AMOUNT | | | |
| EXAMPLE 2 | NICKEL SULFATE | 0.5 M | 127 | NICKEL CHLORIDE | 0.5 M | 186 | PASS | PASS |
| | POTASSIUM BROMIDE | 1.5 M | | POTASSIUM CHLORIDE | 1.5 M | | | |
| | BORIC ACID | 1.0 M | | BORIC ACID | 1.0 M | | | |
| | SEMI-BRIGHTENER | ADEQUATE AMOUNT | | BRIGHTENER | ADEQUATE AMOUNT | | | |
| EXAMPLE 3 | NICKEL BROMIDE | 0.3 M | 108 | NICKEL SULFATE | 0.7 M | 132 | PASS | PASS |
| | LITHIUM SULFATE | 1.0 M | | AMMONIUM CHLORIDE | 1.0 M | | | |
| | SODIUM BORATE | 0.1 M | | AMMONIUM BORATE | 0.7 M | | | |
| | BORIC ACID | 1.0 M | | BRIGHTENER | ADEQUATE AMOUNT | | | |
| EXAMPLE 4 | NICKEL PYROPHOSPHATE | 0.15 M | 102 | NICKEL BROMIDE | 0.5 M | 118 | PASS | PASS |
| | POTASSIUM PYROPHOSPHATE | 1.0 M | | AMMONIUM SULFATE | 1.5 M | | | |
| | AMMONIUM SULFATE | 1.0 M | | BORIC ACID | 1.2 M | | | |
| | AMMONIA WATER | pH 8 | | BRIGHTENER | ADEQUATE AMOUNT | | | |
| | BORIC ACID | 1.0 M | | | | | | |
| EXAMPLE 5 | NICKEL CHLORIDE | 0.7 M | 113 | NICKEL ACETATE | 0.3 M | 162 | PASS | PASS |
| | SODIUM SULFATE | 1.5 M | | LITHIUM CHLORIDE | 2.0 M | | | |
| | BORIC ACID | 1.2 M | | BORIC ACID | 0.7 M | | | |
| | SEMI-BRIGHTENER | ADEQUATE AMOUNT | | BRIGHTENER | ADEQUATE AMOUNT | | | |
| EXAMPLE 6 | NICKEL SULFATE | 0.5 M | 90 | NICKEL CHLORIDE | 0.5 M | 186 | PASS | PASS |
| | LITHIUM CHLORIDE | 1.0 M | | POTASSIUM CHLORIDE | 1.5 M | | | |
| | BORIC ACID | 0.7 M | | BORIC ACID | 1.0 M | | | |
| | SEMI-BRIGHTENER | ADEQUATE AMOUNT | | BRIGHTENER | ADEQUATE AMOUNT | | | |
| EXAMPLE 7 | NICKEL CHLORIDE | 0.4 M | 82 | NICKEL CHLORIDE | 0.5 M | 85 | PASS | PASS |
| | LITHIUM SULFATE | 1.0 M | | MAGNESIUM SULFATE | 1.0 M | | | |
| | BORIC ACID | 1.0 M | | BORIC ACID | 0.5 M | | | |
| | SEMI-BRIGHTENER | ADEQUATE AMOUNT | | BRIGHTENER | ADEQUATE AMOUNT | | | |
| COMPARATIVE EXAMPLE 1 | NICKEL SULFATE | 1.0 M | 58 | NICKEL SULFATE | 1.0 M | 59 | PASS | CORROSION OBSERVED |
| | NICKEL CHLORIDE | 0.25 M | | NICKEL CHLORIDE | 0.25 M | | | |
| | BORIC ACID | 0.6 M | | BORIC ACID | 0.6 M | | | |
| | SEMI-BRIGHTENER | ADEQUATE AMOUNT | | BRIGHTENER | ADEQUATE AMOUNT | | | |
| COMPARATIVE EXAMPLE 2 | NICKEL SULFAMATE | 1.0 M | 72 | — | | — | PASS | CORROSION OBSERVED |
| | NICKEL BORATE | 0.1 M | | | | | | |
| | BORIC ACID | 0.5 M | | | | | | |

Note:
M indicates mol/l.

In Example 4, the concentration of the nickel source in the first plating bath is 0.3 M on a nickel basis.

As shown in Table 1, the rare-earth magnets of Examples 1 through 7 passed the high-temperature high-humidity test and the salt spray test. On the other hand, in the rare-earth magnets of Comparative Examples 1 and 2, corrosion was observed in the salt spray test. In other words, it was found out that when the first protective film was formed through electroplating with the first plating bath including the nickel source, the conductive salt and the pH stabilizer and having a concentration of the nickel source of 0.3 mol/l to 0.7 mol/l, and a conductivity of 80 mS/cm or over, and the second protective film was formed through electroplating with the second plating bath including the nickel source, the conductive salt, the pH stabilizer and the organic sulfur compound, and having a conductivity of 80 mS/cm or over, or when the first protective film was formed through electroplating with the first plating bath including 0.3 mol/l to 0.7 mol/l of nickel ions, at least one kind selected from the group consisting of sulfate ions, chlorine ions, bromine ions, acetate ions and pyrophosphate ions, at least one kind selected from the group consisting of sodium ions, potassium ions, lithium ions, magnesium ions and ammonium ions, and at least one kind selected from the group consisting of borate ions and ammonium ions, and having a conductivity of 80 mS/cm or over, and the second protective film was formed through electroplating with the second plating bath including nickel ions, at least one kind selected from the group consisting of sulfate ions, chlorine ions, bromine ions, acetate ions and pyrophosphate ions, at least one kind selected from the group consisting sodium ions, potassium ions, lithium ions, magnesium ions and ammonium ions, at least one kind selected from the group consisting of borate ions and ammonium ions, and the organic sulfur compound, and having a conductivity of 80 mS/cm or over, superior corrosion resistance can be obtained.

Although the present invention is described referring to the embodiment and the examples, the invention is not limited to the embodiment and the examples, and can be variously modified. For example, in the above embodiment and the above examples, specific examples of the nickel source, the conductive salt and the pH stabilizer are described; however, any other materials may be used.

Moreover, in the above embodiment and the above examples, the case of manufacturing the rare-earth magnet comprising the magnet body, and the first protective film and the second protective film which are laminated on the magnet body is described; however, the invention may be applied to the case of manufacturing a rare-earth magnet comprising any components in addition to them. For example, another film may be formed between the magnet body and the first protective film, between the first protective film and the second protective film, or on the second protective film.

As described above, in the method of manufacturing the rare-earth magnet according to the invention, the first protective film is formed through electroplating with the first plating bath including the nickel source, the conductive salt and the pH stabilizer and having a concentration of the nickel source of 0.3 mol/l to 0.7 mol/l on a nickel atom basis and a conductivity of 80 mS/cm or over, or the first plating bath including 0.3 mol/l to 0.7 mol/l of nickel ions, at least one kind selected from the group consisting of sulfate ions, chlorine ions, bromine ions, acetate ions and pyrophosphate ions, at least one kind selected from the group consisting sodium ions, potassium ions, lithium ions, magnesium ions and ammonium ions, and at least one kind selected from the group consisting of borate ions and ammonium ions, and having a conductivity of 80 mS/cm or over, so the rare-earth-rich phase can be prevented from being leached out, and pinholes can be reduced. Therefore, the corrosion resistance of the rare-earth magnet can be improved.

More specifically, when the second protective film is formed through electroplating with the second plating bath including the nickel source, the conductive salt, the pH stabilizer and the organic sulfur compound, and having a conductivity of 80 mS/cm or over, or the second plating bath including nickel ions, at least one kind selected from the group consisting of sulfate ions, chlorine ions, bromine ions, acetate ions and pyrophosphate ions, at least one kind selected from the group consisting of sodium ions, potassium ions, lithium ions, magnesium ions and ammonium ions, at least one kind selected from the group consisting borate ions and ammonium ions, and the organic sulfur compound, and having a conductivity of 80 mS/cm or over, pinholes can be further reduced, thereby the corrosion resistance of the rare-earth magnet can be further improved.

Moreover, a first plating bath according to the invention comprises the nickel source, the conductive salt and the pH stabilizer, and has a concentration of the nickel source of 0.3 mol/l to 0.7 mol/l on a nickel atom basis and a conductivity of 80 mS/cm or over, or a second plating bath according to the invention comprises 0.3 mol/l to 0.7 mol/l of nickel ions, at least one kind selected from the group consisting of sulfate ions, chlorine ions, bromine ions, acetate ions and pyrophosphate ions, at least one kind selected from the group consisting of sodium ions, potassium ions, lithium ions, magnesium ions and ammonium ions, and at least one kind selected from the group consisting of borate ions and ammonium ions, and has a conductivity of 80 mS/cm or over, or a third plating bath according to the invention comprises the nickel source, the conductive salt, the pH stabilizer and the organic sulfur compound, and has a conductivity of 80 mS/cm or over, or a fourth plating bath according to the invention comprises nickel ions, at least one kind selected from the group consisting of sulfate ions, chlorine ions, bromine ions, acetate ions and pyrophosphate ions, at least one kind selected from the group consisting of sodium ions, potassium ions, lithium ions, magnesium ions and ammonium ions, at least one kind selected from the group consisting of borate ions and ammonium ions and the organic sulfur compound, and has a conductivity of 80 mS/cm or over, so the method of manufacturing the rare-earth magnet can be achieved.

What is claimed is:

1. A method of manufacturing a rare-earth magnet, comprising the steps of:

electroplating a first protective film including nickel on a magnet body including a rare-earth element with a first plating bath of a water solution, the first plating bath consisting of a nickel source, a conductive salt, a pH stabilizer, and a semi-brightener and having a concentration of the nickel source of 0.3 mol/l to 0.7 mol/l on a nickel atom basis and a conductivity of 80 mS/cm or over, the nickel source is selected from the group consisting of nickel sulfate, nickel chlorides and nickel bromides and the pH stabilizer is selected from the group consisting of boric acid, sodium borate, potassium borate, lithium borate and magnesium borate; and forming a second protective film including nickel and sulfur on the first protective film.

2. A method of manufacturing a rare-earth magnet according to claim 1, wherein the conductive salt is selected from the group consisting of sodium sulfate, potassium sulfate, lithium sulfate, magnesium sulfate, sodium chloride, potassium chloride, lithium chloride, magnesium chloride, sodium bromide, potassium bromide, lithium bromide and magnesium bromide.

3. A method of manufacturing a rare-earth magnet according to claim 1, wherein the second protective film is formed by electroplating with a second plating bath including a nickel source, a conductive salt, a pH stabilizer and an organic sulfur compound, and having a conductivity of 80 mS/cm or over.

4. A method of manufacturing a rare-earth magnet according to claim 3, wherein the nickel source is selected from the group consisting of nickel sulfate, nickel chlorides and nickel bromides.

5. A method of manufacturing a rare-earth magnet according to claim 3, wherein the conductive salt is selected from the group consisting of sodium sulfate, potassium sulfate, lithium sulfate, magnesium sulfate, sodium chloride, potassium chloride, lithium chloride, magnesium chloride, sodium bromide, potassium bromide, lithium bromide and magnesium bromide.

6. A method of manufacturing a rare-earth magnet according to claim 3, wherein the pH stabilizer is selected from the group consisting of boric acid, sodium borate, potassium borate, lithium borate and magnesium borate.

7. A method of manufacturing a rare-earth magnet according to claim 1, wherein the first plating bath consists of the nickel source, the conductive salt, and the pH stabilizer.

8. A method of manufacturing a rare-earth magnet, comprising the steps of:

electroplating a first protective film including nickel on a magnet body including a rare-earth element with a first plating bath of a water solution, the first plating bath consisting of 0.3 mol/l to 0.7 mol/l of nickel ions, at least one ion selected from the group consisting of sulfate ions, chlorine ions and bromine ions, at least one ion selected from the group consisting of sodium ions, potassium ions, lithium ions and magnesium ions, a borate ion, and a semi-brightener and having a conductivity of 80 mS/cm or over; and forming a second protective film including nickel and sulfur on the first protective film.

9. A method of manufacturing a rare-earth magnet according to claim 8, wherein the second protective film is formed by electroplating with a second plating bath including nickel ions, at least one ion selected from the group consisting of sulfate ions, chlorine ions and bromine ions, at least one ion selected from the group consisting of sodium ions, potassium ions, lithium ions and magnesium ions, a borate ion and an organic sulfur compound, and having a conductivity of 80 mS/cm or over.

* * * * *